US006907921B2

(12) United States Patent
Insley et al.

(10) Patent No.: US 6,907,921 B2
(45) **Date of Patent: *Jun. 21, 2005**

(54) MICROCHANNELED ACTIVE FLUID HEAT EXCHANGER

(75) Inventors: Thomas I. Insley, West Lakeland Township, MN (US); Raymond P. Johnston, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 541 days.

This patent is subject to a terminal disclaimer.

(21) Appl. No.: 09/099,632

(22) Filed: Jun. 18, 1998

(65) Prior Publication Data

US 2002/0011330 A1 Jan. 31, 2002

(51) Int. Cl.[7] ..... F28F 3/12
(52) U.S. Cl. ..... 165/170; 165/166
(58) Field of Search ..... 165/166, 168, 165/170

(56) References Cited

U.S. PATENT DOCUMENTS

| | | | | | |
|---|---|---|---|---|---|
| 3,246,689 | A | * | 4/1966 | Remde et al. | 165/170 X |
| 3,520,300 | A | | 7/1970 | Flower, Jr. | |
| 3,715,192 | A | | 2/1973 | Wenz et al. | |
| 3,965,887 | A | * | 6/1976 | Gramer et al. | 165/170 X |

(Continued)

FOREIGN PATENT DOCUMENTS

| | | | | |
|---|---|---|---|---|
| DE | 32 12 295 | | 10/1983 | |
| DE | 42 10 072 | | 3/1993 | |
| DE | 195 01 017 | | 7/1996 | |
| DE | 195 41 266 | A1 | 5/1997 | |
| EP | 0 039 291 | | 11/1981 | |
| FR | 375936 | * | 7/1907 | 165/170 X |
| GB | 1 338 579 | | 11/1973 | |
| GB | 1 354 502 | | 5/1974 | |
| GB | 1 418 635 | | 12/1975 | |
| WO | 04628 | | 6/1989 | |
| WO | 11727 | | 6/1993 | |
| WO | 02357 | | 1/1997 | |
| WO | 13633 | | 4/1997 | |
| WO | 00231 | | 1/1998 | |
| WO | 24544 | | 6/1998 | |
| WO | 06589 | | 2/1999 | |

OTHER PUBLICATIONS

Product Literature: Kerforschungszentrum Karlsruhe, "Metal Micro Heat Exchangers,", date unknown.

Peter Zuska, "Microtech Opens Doors To The Universe Of Small Space", Med Device & Diagnostic Industry, Jan. 1997; p. 131–137.

(Continued)

*Primary Examiner*—Leonard R. Leo
(74) *Attorney, Agent, or Firm*—Karl G. Hanson; James A. Rogers; Christopher D. Gram

(57) ABSTRACT

A heat exchanger utilizing active fluid transport of a heat transfer fluid has multiple discrete flow passages provided by a simple but versatile construction. The microstructured channels are replicated onto a film layer which is utilized in the fluid transfer heat exchanger. The surface structure defines the flow channels which are generally uninterrupted and highly ordered. These flow channels can take the form of linear, branching or dendritic type structures. A cover layer having favorably thermal conductive properties is provided on the structured bearing film surface. Such structured bearing film surfaces and the cover layer are thus used to define microstructure flow passages. The use of a film layer having a microstructured surface facilitates the ability to highly distribute a potential across the assembly of passages to promote active transport of a heat transfer fluid. The thermally conductive cover layer then effects heat transfer to an object, gas, or liquid in proximity with the heat exchanger.

28 Claims, 4 Drawing Sheets

U.S. PATENT DOCUMENTS 3,993,566 A 11/1976 Goldberg et al. ..... 210/433 M
4,130,160 A * 12/1978 Dziedzic et al. ..... 165/166
4,134,389 A * 1/1979 McClintock ..... 165/170 X
4,233,029 A 11/1980 Columbus
4,271,119 A 6/1981 Columbus
4,277,966 A 7/1981 Rambauske
4,347,896 A * 9/1982 Rosman et al. ..... 165/166
4,386,505 A * 6/1983 Little ..... 165/168 X
4,392,362 A 7/1983 Little ..... 165/168 X
4,413,407 A 11/1983 Columbus
4,516,632 A * 5/1985 Swift et al. ..... 165/166 X
4,533,352 A 8/1985 Van Beek et al.
4,579,555 A 4/1986 Russo
4,601,861 A 7/1986 Pricone et al. ..... 264/1.6
4,639,748 A 1/1987 Drake et al.
4,668,558 A 5/1987 Barber
4,677,705 A 7/1987 Schuster
4,742,870 A * 5/1988 Darone et al. ..... 165/170 X
4,758,481 A 7/1988 Fauvel ..... 429/39
4,871,623 A 10/1989 Hoopman et al.
4,894,709 A * 1/1990 Phillips et al. ..... 257/714
4,906,439 A 3/1990 Grenner ..... 422/56
4,913,858 A 4/1990 Miekka et al.
4,950,549 A 8/1990 Rolando et al.
5,005,640 A * 4/1991 Lapinski et al. ..... 165/170
5,014,389 A 5/1991 Ogilvie et al.
5,069,403 A 12/1991 Marentic et al.
5,070,606 A 12/1991 Hoopman et al.
5,078,925 A 1/1992 Rolando et al.
5,133,516 A 7/1992 Marentic et al.
5,148,861 A * 9/1992 Colvin et al. ..... 165/78
5,152,060 A 10/1992 Schubert et al.
5,158,557 A 10/1992 Noreen et al.
5,175,030 A 12/1992 Lu et al.
5,176,667 A 1/1993 DeBring
5,200,248 A 4/1993 Thompson et al.
5,205,348 A 4/1993 Tousignant et al.
5,249,358 A 10/1993 Tousignant et al.
5,249,359 A 10/1993 Schubert et al.
5,317,805 A 6/1994 Hoopman et al.
5,376,252 A 12/1994 Eström et al. ..... 204/299
5,411,858 A 5/1995 McGeehan et al.
5,437,651 A 8/1995 Todd et al.
5,440,332 A 8/1995 Good
5,450,235 A 9/1995 Smith et al.
5,457,848 A 10/1995 Miwa
5,514,120 A 5/1996 Johnston et al.
5,527,588 A 6/1996 Camarda et al.
5,534,576 A 7/1996 Grot
5,601,678 A 2/1997 Gerber et al.
5,628,735 A 5/1997 Skow
5,651,888 A 7/1997 Shimizu et al.
5,691,846 A 11/1997 Benson, Jr. et al.
5,692,263 A 12/1997 Sorenson
5,692,558 A * 12/1997 Hamilton et al. ..... 257/714 X
5,703,633 A 12/1997 Gehrer et al.
5,728,446 A 3/1998 Johnston et al.
5,763,951 A * 6/1998 Hamilton et al. ..... 257/714
5,771,964 A * 6/1998 Bae ..... 165/144
5,842,787 A 12/1998 Kopf-Sill et al.
5,885,470 A 3/1999 Parce et al.
5,932,315 A 8/1999 Lum et al.
6,290,685 B1 * 9/2001 Insley et al. ..... 604/317
6,514,412 B1 * 2/2003 Insley et al. ..... 210/649

OTHER PUBLICATIONS

Ottow et al; "Processing of 3D Microstructures Using Macroporous n–Type Silicon", J. Electrochem. Soc., vol. 143, No. 1, Jan 1996; p. 385–390.

Bier et al. "Gas to gas heat transfer in micro heat exchangers", Chem. Engineering & Processing; 32 (1993) 33–43, 1993.

Article: "Fabrication of Novel Three–Dimensional Microstructures by the Anisotropic Etching of (100) and (110) Silicon", Ernest Bassous, *IEEE Transactions on Electron Devices*, vol. ED–25, No. 10, Oct. 1978.

Article: "Simple and Low Cost Fabrication of Embedded Micro–Channels by Using a New Thick–Film Photoplastic" Guerin, et al. Digest of Technical Papers, vol. 2, Jun. 1997.

Article: "Fabrication of Microstructures with high aspect ratios and great structural heights by synchrotron radition lithography, galvanoforming, and plastic moulding (LIGA process)" Becker, et al. *MiMicroelectronic Engineering* 4 (1986).

Article: "UV Laser Machined Polymer Substrates for the Development of Microdiagnostic Systems" Roberts, et al. *Analytical Chemistry*, vol. 69, No. 11, Jun. 1997.

* cited by examiner

MICROCHANNELED ACTIVE FLUID HEAT EXCHANGER

The present invention relates to heat exchangers that include a microchanneled structured surface defining small discrete channels for active fluid flow as a heat transfer medium.

BACKGROUND

Heat flow is a form of energy transfer that occurs between parts of a system at different temperatures. Heat flows between a first media at one temperature and a second media at another temperature by way of one or more of three heat flow mechanisms: convection, conduction, and radiation. Heat transfer occurs by convection through the flow of a gas or a liquid, such as a part being cooled by circulation of a coolant around the part. Conduction, on the other hand, is the transfer of heat between non-moving parts of system, such as through the interior of solid bodies, liquids, and gases. The rate of heat transfer through a solid, liquid, or gas by conduction depends upon certain properties of the solid, liquid, or gas being thermally effected, including its thermal capacity, thermal conductivity, and the amount of temperature variation between different portions of the solid, liquid, or gas. In general, metals are good conductors of heat, while cork, paper, fiberglass, and asbestos are poor conductors of heat. Gases are also generally poor conductors due to their dilute nature.

Common examples of heat exchangers include burners on an electric stove and immersion heaters. In both applications, an electrically conductive coil is typically used that is subjected to an electric current. The resistance in the electric coil generates heat, which can then be transferred to a media to be thermally effected through either conduction or convention by bringing the media into close proximity or direct contact with the conductive coil. In this manner, liquids can be maintained at a high temperature or can be chilled, and food can be cooked for consumption.

Because of the favorable conductive and convective properties associated with many types of fluid media and the transportability of fluids (i.e. the ability to pump, for example, a fluid from one location to another), many heat exchangers utilize a moving fluid to promote heat transfer to or from an object or other fluid to be thermally affected. A common type of such a heat exchanger is one in which a heat transfer fluid is contained within and flows through a confined body, such as a tube. The transfer of heat is accomplished from the heat transfer fluid to the wall of the tube or other confinement surface of the body by convection, and through the confinement surface by conduction. Heat transfer to a media desired to be thermally affected can then occur through convection, as when the confinement surface is placed in contact with a moving media, such as another liquid or a gas that is to be thermally affected by the heat exchanger, or through conduction, such as when the confinement surface is placed in direct contact with the media or other object desired to be thermally affected. To effectively promote heat transfer, the confinement surface should be constructed of a material having favorable conductive properties, such as a metal.

Specific applications in which heat exchangers have been advantageously employed include the microelectronics industry and the medical industry. For example, heat exchangers are used in connection with microelectronic circuits to dissipate the concentrations of heat produced by integrated circuit chips, microelectronic packages, and other components or hybrids thereof. In such an application, cooled forced air or cooled forced liquid can be used to reduce the temperature of a heat sink located adjacent to the circuit device to be cooled. An example of a heat exchanger used within the medical field is a thermal blanket used to either warm or cool patients.

Fluid transport by a conduit or other device in a heat exchanger to effect heat transfer may be characterized based on the mechanism that causes flow within the conduit or device. Where fluid transport pertains to a nonspontaneous fluid flow regime where the fluid flow results, for the most part, from an external force applied to the device, such fluid transport is considered active. In active transport, fluid flow is maintained through a device by means of a potential imposed over the flow field. This potential results from a pressure differential or concentration gradient, such as can be created using a vacuum source or a pump. Regardless of the mechanism, in active fluid transport it is a potential that motivates fluid flow through a device. A catheter that is attached to a vacuum source to draw liquid through the device is a well-known example of an active fluid transport device.

On the other hand, where the fluid transport pertains to a spontaneous flow regime where the fluid movement stems from a property inherent to the transport device, the fluid transport is considered passive. An example of spontaneous fluid transport is a sponge absorbing water. In the case of a sponge, it is the capillary geometry and surface energy of the sponge that allows water to be taken up and transported through the sponge. In passive transport, no external potential is required to motivate fluid flow through a device. A passive fluid transport device commonly used in medical procedures is an absorbent pad.

The present invention is directed to heat exchangers utilizing active fluid transport. The design of active fluid transport devices in general depends largely on the specific application to which it is to be applied. Specifically, fluid transport devices are designed based upon the volume, rate and dimensions of the particular application. This is particularly evident in active fluid transport heat exchangers, which are often required to be used in a specialized environment involving complex geometries. Moreover, the manner by which the fluid is introduced into the fluid transport device affects its design. For example, where fluid flow is between a first and second manifold, as is often the case with heat exchangers, one or multiple discrete paths can be defined between the manifolds.

In particular, in an active fluid transport heat exchanger, it is often desirable to control the fluid flow path. In one sense, the fluid flow path can be controlled for the purpose of running a particular fluid nearby an object or another fluid to remove heat from or to transfer heat to the object or other fluid in a specific application. In another sense, control of the fluid flow path can be desirable so that fluid flows according to specific flow characteristics. That is, fluid flow may be facilitated simply through a single conduit, between layers, or by way of plural channels. The fluid transport flow path may be defined by multiple discrete channels to control the fluid flow so as to, for example, minimize crossover or mixing between the discrete fluid channels. Heat exchange devices utilizing active fluid transport are also designed based upon the desired rate of heat transfer, which affects the volume and rate of the fluid flow through the heat exchanger, and on the dimensions of the heat exchanger.

Rigid heat exchangers having discrete microchannels are described in each of U.S. Pat. No. 5,527,588 to Camarda et al., U.S. Pat. No. 5,317,805 to Hoopman et al. (the '805 patent), and U.S. Pat. No. 5,249,358 to Tousignant et al. In each case, a microchanneled heat exchanger is produced by material deposition (such as by electroplating) about a sacrificial core, which is later removed to form the microchannels. In Camarda, the filaments are removed after deposition to form tubular passageways into which a working fluid is sealed. In the '805 patent to Hoopman et al, a heat exchanger comprising a first and second manifolds connected by a plurality of discrete microchannels is described. Similarly, U.S. Pat. No. 5,070,606 to Hoopman et al. describes a rigid apparatus having microchannels that can be used as a heat exchanger. The rigid microchanneled heat exchanger is made by forming a solid body about an arrangement of fibers that are subsequently removed to leave microchannels within the solid formed body. A heat exchanger is also described in U.S. Pat. No. 4,871,623 to Hoopman et al. The heat exchanger provides a plurality of elongated enclosed electroformed channels that are formed by electrodepositing material on a mandrel having a plurality of elongated ridges. Material is deposited on the edges of the ridges at a faster rate than on the inner surfaces of the ridges to envelope grooves and thus create a solid body having microchannels. Rigid heat exchangers are also known having a series of micropatterned metal platelets that are stacked together. Rectangular channels (as seen in cross section) are defined by milling channels into the surfaces of the metal platelets by microtooling.

SUMMARY OF THE INVENTION

The present invention overcomes the shortcomings and disadvantages of known heat exchangers by providing a heat exchanger that utilizes active fluid transport through a highly distributed system of small discrete passages. More specifically, the present invention provides a heat exchanger having plural channels, preferably microstructured channels, formed in a layer of polymeric material having a microstructured surface. The microstructured surface defines a plurality of microchannels that are completed by an adjacent layer to form discrete passages. The passages are utilized to permit active transport of a fluid to remove heat from or transfer heat to an object or fluid in proximity with the heat exchanger.

By the present invention, a heat exchanger is produced that can be designed for a wide variety of applications. The heat exchanger can be flexible or rigid depending on the material from which the layers, including the layer containing the microstructured channels, are comprised. The system of microchannels can be used to effectively control fluid flow through the device while minimizing mixing or crossover between channels. Preferably, the microstructure is replicated onto inexpensive but versatile polymeric films to define flow channels, preferably a microchanneled surface. This microstructure provides for effective and efficient active fluid transport while being suitable in the manufacturing of a heat exchanger for thermally effecting a fluid or object in proximity to the heat exchanger. Further, the small size of the flow channels, as well as their geometry, enable relatively high forces to be applied to the heat exchanger without collapse of the flow channels. This allows the fluid transport heat exchanger to be used in situations where it might otherwise collapse, i.e. under heavy objects or to be walked upon. In addition, such a microstructured film layer maintains its structural integrity over time.

The microstructure of the film layer defines at least a plurality of individual flow channels in the heat exchanger, which are preferably uninterrupted and highly ordered. These flow channels can take the form of linear, branching or dendritic type structures. A layer of thermally conductive material is applied to cover the microstructured surface so as to define plural substantially discrete flow passages. A source of potential—which means any source that provides a potential to move a fluid from one point to another—is also applied to the heat exchanger for the purpose of causing active fluid transport through the device. Preferably, the source is provided external to the microstructured surface so as to provide a potential over the flow passages to promote fluid movement through the flow passages from a first potential to a second potential. The use of a film layer having a microstructured surface in the heat exchanger facilitates the ability to highly distribute the potential across the assembly of channels.

By utilizing microstructured channels within the present invention, the heat transfer fluid is transported through a plurality of discrete passages that define thin fluid flows in the microstructured channels, which minimizes flow stagnation within the conducted fluid, and which promotes uniform residence time of the heat transfer fluid across the device in the direction of active fluid transport. These factors contribute to the overall efficiency of the device and allow for smaller temperature differentials between the heat transfer fluid and the media to be thermally effected. Moreover, the film surfaces having the microstructured channels can provide a high contact heat transfer surface area per unit volume of heat transfer fluid to increase the system's volumetric efficiency.

The above advantages of the present invention can be achieved by an active fluid transport heat exchanger including a layer of polymeric material having first and second major surfaces, wherein the first major surface is defined by a structured polymeric surface formed within the layer, the structured polymeric surface having a plurality of flow channels that extend from a first point to a second point along the surface of the layer. The flow channels preferably have a minimum aspect ratio of about 10:1, defined as the channel length divided by the hydraulic radius, and a hydraulic radius no greater than about 300 micrometers. A cover layer of material having favorable thermal conductive properties is positioned over the at least a plurality of the flow channels of the structured polymeric surface to define discrete flow passages from at least a plurality of the flow channels. A source is also provided external to the structured polymeric surface so as to provide a potential over the discrete flow passages to promote movement of fluid through the flow passages from a first potential to a second potential. In this manner, heat transfer between the moving fluid and the cover layer of thermally conductive material, and thus to a media to be thermally affected, can be achieved.

Preferably, also at least one manifold is provided in combination with the plurality of channels for supplying or receiving fluid flow through the channels of the structured surface of the heat exchanger.

DETAILED DESCRIPTION OF PREFERRED EMBODIMENTS

Figures 1, 2:
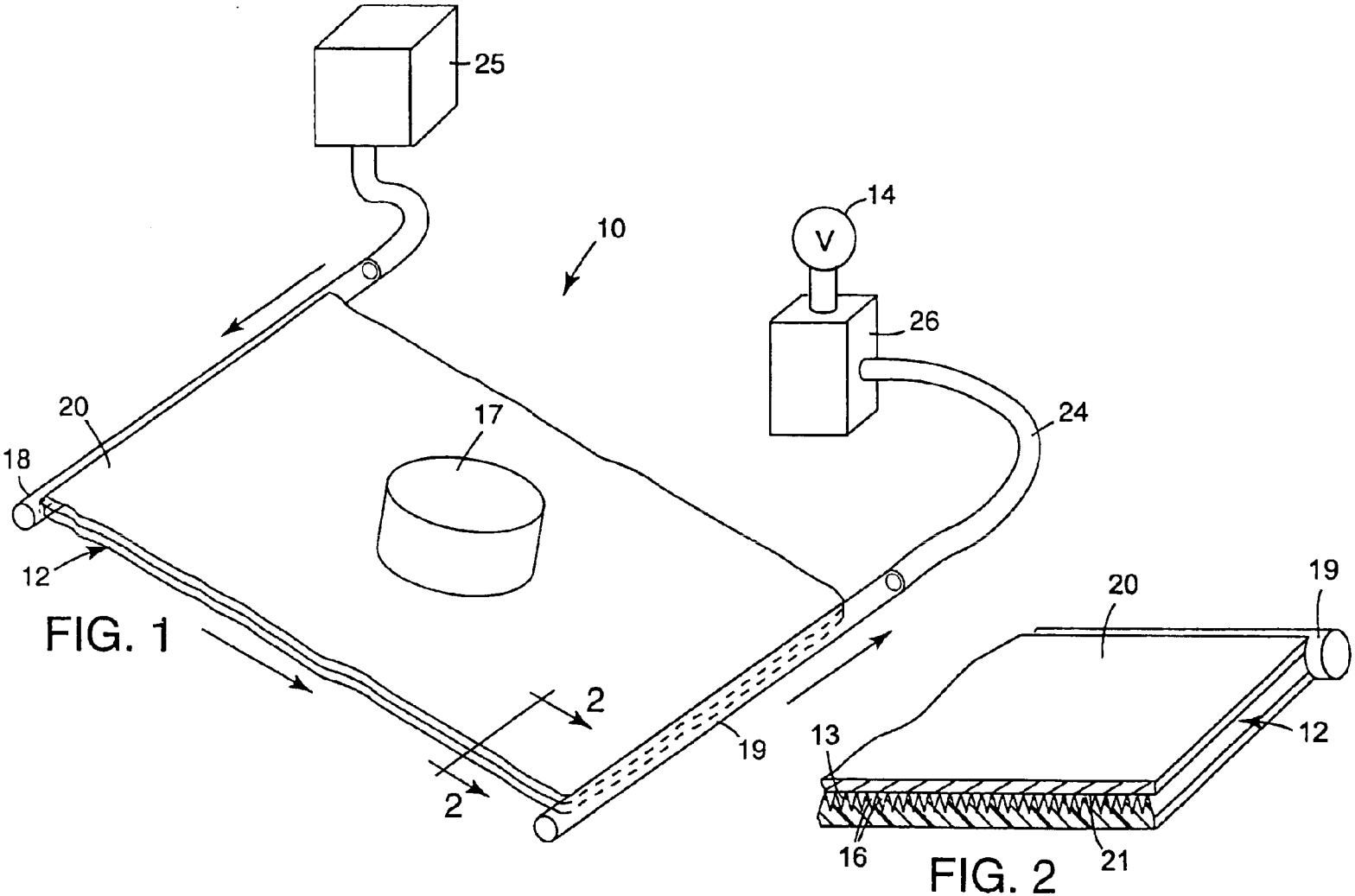
FIG. 1 is a perspective view of an active fluid transport heat exchanger in accordance with the invention having a structured layer combined with a cover layer of thermally conductive material to provide multiple discrete flow passages, and which passages are connected between a first manifold and a second manifold, the first manifold being connected to a source to provide a potential across the multiple discrete passages.
FIG. 2 is an enlarged partial cross-sectional view in perspective of the active fluid transport heat exchanger of FIG. 1 taken along line 2—2 of FIG. 1.

With reference to the attached Figures, like components are labeled with like numerals throughout the several Figures. In FIGS. 1 and 2, an active fluid transfer heat exchanger 10 is illustrated. The active fluid transfer heat exchanger 10 basically includes a layer 12 of material having a structured surface 13 on one of its two major surfaces, a cover layer 20 of thermally conductive material, and a source 14 for providing a potential to the active fluid transfer heat exchanger 10. Structured surface 13 of layer 12 can be provided defining a large number and high density of fluid flow channels 16 on a major surface thereof. The channels 16 (best shown in FIG. 2) are preferably arranged so that inlets are in fluidic communication with an inlet manifold 18, while at another edge of the device 10, an outlet manifold 19 can be fluidically connected to outlets of the channels 16. Such an active fluid transfer device 10 provides for the circulation of a particular fluid through the device 10 by way of the inlet manifold 18 and outlet manifold 19, whereby the fluid passing through the device 10 can be utilized to promote heat transfer through one or both of the layer 12 and the cover layer 20 of the device 10.

The layer 12 may comprise flexible, semi-rigid, or rigid material, which may be chosen depending on the particular application of the active fluid transfer heat exchanger 10. Preferably, the layer 12 comprises a polymeric material because such materials are typically less expensive and in that such polymeric materials can be accurately formed with a structured surface 13. Structured surface 13 is preferably a microstructured surface. A great deal of versatility is available because of the many different properties of polymeric materials that are suitable for making microstructured surfaces. Polymeric materials may be chosen, for example, based on flexibility, rigidity, permeability, etc. Polymeric material provide numerous advantages as compared with other materials, including having reduced thermal expansion and contraction characteristics, and being compression conformable to the contours of an interface, non-corrosive, thermo-chromatic, electrically non-conductive, and having a wide range of thermal conductivity. Moreover, by the use of a polymeric layer 12 comprising, for example, a film layer, a structured surface can be provided defining a large number of and high density of fluid flow channels 16 on a major surface thereof. Thus, a highly distributed fluid transport system can be provided that is amenable to being manufactured with a high level of accuracy and economy.

The first and second manifolds 18 and 19, respectively, preferably are in fluid communication with each of the fluid flow channels 16 through inlets and outlets (not shown) thereof, and are each provided with an internal chamber (not shown) that is defined therein and which is in fluid communication with channels 16. Manifolds 18 and 19 are preferably fluidly sealed to the layers 12 and 20 by any known or developed technique, such as by conventional sealant. The internal chamber of inlet and outlet manifolds 18 and 19 are also thus sealingly connected to at least a plurality of the channels 16. The manifolds 18 and 19 may be flexible, semi-rigid, or rigid, like the layer 12.

To close off at least a plurality of the channels 16 and thus define discrete fluid flow passages, a cover layer 20 is preferably provided. At least a plurality of the channels 16 may be completed as flow passages by a closing surface 21 of the cover layer 20. The cover layer 20 is also sealingly connected with the manifolds 18 and 19 so that plural discrete flow passages are formed that provide active fluid transport through heat exchanger 10 based upon the creation of a potential difference across the channels 16 from a first potential to a second potential. Cover layer 20 is preferably formed from a thermally conductive material to promote heat transfer between the fluid flowing through the flow passages and an element 17, for example, that is desired to be thermally affected. It is contemplated that the element 17 to be thermally affected can comprise any number of objects, fluids, gases, or combinations thereof, depending upon a particular application.

Cover layer 20 can have a thermal conductivity that is greater than the layer 12. Thermal conductivity is a quantifiable property of a specific material that characterizes its ability to transfer heat and in part determines the heat transfer rate through the material. Specifically, heat transfer rate is proportional to the physical dimensions, including cross-sectional profile and thickness, of a material and the difference in temperature in the material. The proportionality constant is defined as the material's thermal conductivity, and is expressed in terms of power per unit distance times degree. That is, when measuring heat transfer using metric units, thermal conductivity is expressed in terms of watts per meter-degree Celsius ((W/(m*° C.)). Substances that are good heat conductors have large thermal conductivity, while insulation substances have low thermal conductivity.

Moreover, it is contemplated that closing surface 21 may be provided from other than a cover layer 20, such as by a surface of the object that is desired to be thermally affected. That is, the closing surface 21 can be part of any object which is intended to be thermally affected and to which layer 12 can be brought into contact. Such a construction can thus be used to promote heat transfer between fluid flowing in the passages defined between layer 12 and the closing surface 21 and the object to be thermally affected. As above, the closing surface 21 of an object may only close off at least a plurality of the channels 16 to thus define plural discrete fluid flow passages. The object and the layer 12 having a structured surface 13 may be constructed as a unit by assembling them together in a permanent manner, or the structured surface of the layer 12 may be temporarily held or otherwise maintained against the closing surface of the object. In the case of the former, one or more manifolds may be sealingly provided as part of the assembly. To the latter, one or more manifolds may be sealingly connected to just the layer 12.

In accordance with the present invention, the potential source may comprise any means that provides a potential difference across a plurality of the flow passages from a first potential to a second potential. The potential difference should be sufficient to cause, or assist in causing, fluid flow through the discrete passages defined by plural flow channels 16 and cover layer 20, which is based in part on the fluid characteristics of any particular application. As shown in FIG. 1, with the direction of fluid flow defined through inlet manifold 18, through the body of heat exchanger 10 made up of layers 12 and 20, and through outlet manifold 19 as indicated by the arrows, a potential source 14 may comprise a vacuum generator that is conventionally connected with a collector receptacle 26. The collector receptacle 26 is fluidically connected with the outlet manifold 19 by way of a conventional flexible tube 24. Thus, by the provision of a vacuum at the potential source 14, fluid can be drawn from a fluid source 25, provided outside the active fluid transfer heat exchanger 10, through inlet manifold 18, into the inlets (not shown), through the flow passages, through outlet manifold 19, through tube 24 and into the collection receptacle 26. The receptacle 26 may advantageously be connected with the source 25 to provide a recirculating system, in which case, it may be desirable to reheat or recool the fluid therein, prior to reuse. That is, receptacle 26 may be connected to a system whereby heat is transferred into or out of the fluid contained within receptacle 26 to restore the fluid to its initial temperature prior to being drawn through heat exchanger 10. This restored fluid can then be supplied to fluid source 25 for reuse in heat exchanger 10.

With flexible materials used for layers 12 and 20, the mechanically flexible nature of such a heat exchanger 10 would allow it to be beneficially used in contoured configurations. Flexible devices may be relatively large so as to provide a highly distributed fluid flow, whereby a large area can be affected by the device. A flexible fluid transfer heat exchanger can take the form of a blanket, for example, for cooling or heating a patient. Such a flexible device can be conformable to an object, wrapped about an object, or may be conformable along with an object (e.g. provided on a cushion) to promote heat transfer therethrough. More specifically, the flexible nature of such a heat exchanger device improves the surface contact between it and the object to be thermally affected, which in turn promotes heat transfer. Although the fluid transfer device can be flexible, it can also demonstrate resistances to collapse from loads and kinking. The microstructure of the layer 12, which may comprise a polymeric film, provides sufficient structure that can be utilized within an active fluid transfer heat exchanger in accordance with the present invention to have sufficient load-bearing integrity to support, for example, a standing person or a prone person.

Figure 3A:
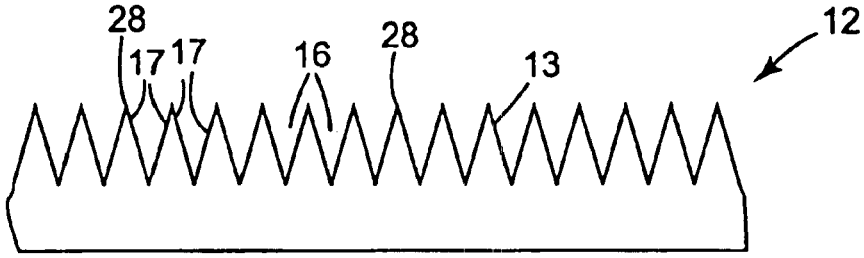
FIGS. 3*a* through 3*c* are end views of structured layers for illustrating possible flow channel configurations that may be used in a heat exchanger in accordance with the present invention.

As shown in FIG. 3*a*, flow channels 16 can be defined in accordance with the illustrated embodiment by a series of peaks 28. In some cases, it will be desirable to extend the peaks 28 entirely from one edge of the layer 12 to another; although, for other applications, it may be desirable to extend the peaks 28 only along a portion of the structured surface 13. That is, channels 16 that are defined between peaks 28 may extend entirely from one edge to another edge of the layer 12, or such channels 16 may only be defined to extend over a portion of the layer 12. That channel portion may begin from an edge of the layer 12, or may be entirely intermediately provided within the structured surface 13 of the layer 12.

The closing surface 21 of a cover layer 20 or of a surface to be thermally affected may be bonded to peaks 28 of some or all of the structured surface 13 to enhance the creation of discrete flow passages within heat exchanger 10. This can be done by the use of conventional adhesives that are compatible with the materials of the closing surface 21 and layer 12, or may comprise other heat bonding, ultrasonic bonding or other mechanical devices, or the like. Bonds may be provided entirely along the peaks 28 to the closing surface 21, or may be spot bonds that may be provided in accordance with an ordered pattern or randomly.

In the case where the potential source 14 comprises a vacuum generator, the vacuum provided to the channels 16 via outlet manifold 19 can be sufficient to adequately seal the closing surface 21 to the peaks 28. That is, the vacuum itself will tend to hold the closing surface 21 against peaks 28 to form the discrete flow passages of heat exchanger 10. Preferably, each of the channels 16 that are defined by the structured surface 13 is completely closed off by the closing surface 21 so as to define a maximum number of substantially discrete flow passages. Thus, crossover of fluid between channels 16 is effectively minimized, and the potential provided from an external source can be more effectively and efficiently distributed over the structured surface 13 of layer 12. It is contemplated, however, that the structured surface 13 can include features within channels 16 that permit fluid crossover between the flow passages at certain points. This can be accomplished by not attaching portions of intermediate peaks 28 to closing surface 21, or by providing openings through the peaks 28 at selected locations.

Other potential sources 14 are useable in accordance with the present invention instead of or in conjunction with a vacuum generation device. Generally, any manner of causing fluid flow through the flow passages is contemplated. That is, any external device or source of potential that causes or assists in fluid to be transported through the passages is contemplated. Examples of other potential sources include but are not limited to, vacuum pumps, pressure pumps and pressure systems, magnetic systems, magneto hydrodynamic drives, acoustic flow systems, centrifugal spinning, gravitational forces, and any other known or developed fluid drive system utilizing the creation of a potential difference that causes fluid flow to at least to some degree.

Figure 3B:
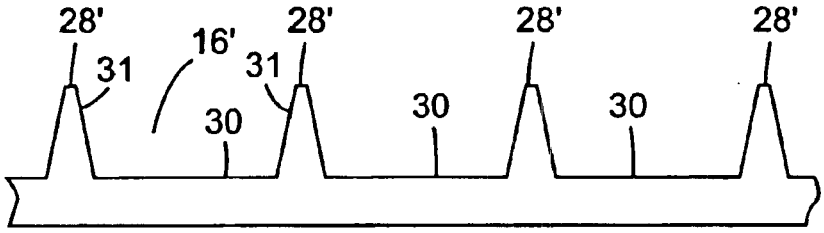

Although the embodiment of FIG. 1 is shown as having a structured surface comprising multiple peaks 28 continuously provided from one side edge to another (as shown in FIG. 3*a*), other configurations are contemplated. For example, as shown in FIG. 3*b*, channels 16' have a wider flat valley between slightly flattened peaks 28'. Like the FIG. 3*a* embodiment, the thermally conductive cover layer 20 can be secured along one or more of the peaks 28' to define discrete channels 16'. In this case, bottom surfaces 30 extend between channel sidewalls 31, whereas in the FIG. 3*a* embodiment, sidewalls 17 connect together along lines.

Figure 3C:
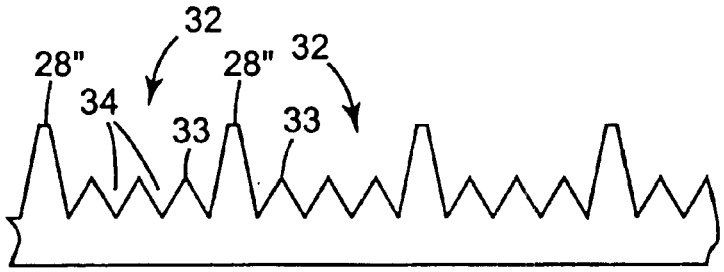

In FIG. 3*c*, yet another configuration is illustrated. Wide channels 32 are defined between peaks 28", but instead of providing a flat surface between channel sidewalls, a plurality of smaller peaks 33 are provided between the sidewalls of the peaks 28". These smaller peaks 33 thus define secondary channels 34 therebetween. Peaks 33 may or may not rise to the same level as peaks 28", and as illustrated create a first wide channel 32 including smaller channels 34 distributed therein. The peaks 28" and 33 need not be evenly distributed with respect to themselves or each other.

Although FIGS. 1, 2, and 3*a*–3*c* illustrate elongated, linearly-configured channels in layer 12, the channels may be provided in many other configurations. For example, the channels could have varying cross-sectional widths along the channel length; that is, the channels could diverge and/or converge along the length of the channel. The channel sidewalls could also be contoured rather than being straight in the direction of extension of the channel, or in the channel height. Generally, any channel configuration that can provide at least multiple discrete channel portions that extend from a first point to a second point within the fluid transfer device are contemplated.

Figure 5A:
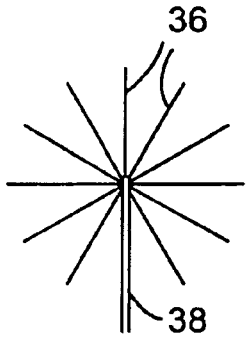
FIGS. 5*a* and 5*b* are top views of structured layers for illustrating alternative non-linear channel structures that may be used in a heat exchanger in accordance with the present invention.
Figure 5B:
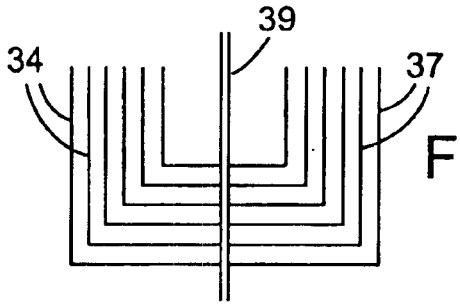

In FIG. 5*a*, a channel configuration is illustrated in plan view that may be applied to the layer 12 to define the structured surface 13. As shown, plural converging channels 36 having inlets (not shown) that can be connected to a manifold for receiving heat transfer fluid can be provided. Converging channels 36 are each fluidly connected with a single, common channel 38. This minimizes the provision of outlet ports (not shown) to one. As shown in FIG. 5*b*, a central channel 39 may be connected to a plurality of channel branches 37 that may be designed to cover a particular area for similar reasons. Again, generally any pattern is contemplated in accordance with the present invention as long as a plurality of individual channels are provided over a portion of the structured surface 13 from a first point to a second point. Like the above embodiments, the patterned channels shown in FIGS. 5*a* and 5*b* are preferably completed as flow passages by a closing surface such as provided by a surface of an object to be thermally affected or by a cover layer of thermally conductive material to define discrete flow passages and to promote heat transfer to a body to be thermally affected.

Individual flow channels of the microstructured surfaces of the invention may be substantially discrete. If so, fluid will be able to move through the channels independent of fluid in adjacent channels. Thus the channels can independently accommodate the potential relative to one another to direct a fluid along or through a particular channel independent of adjacent channels. Preferably, fluid that enters one flow channel does not, to any significant degree, enter an adjacent channel, although there may be some diffusion between adjacent channels. By maintaining discreteness of the micro-channels in order to effectively transport heat exchanger fluid, heat transfer to or from an object can be better promoted. Such benefits are detailed below.

As used here, aspect ratio means the ratio of a channel's length to its hydraulic radius, and hydraulic radius is the wettable cross-sectional area of a channel divided by its wettable channel circumference. The structured surface is a microstructured surface that preferably defines discrete flow channels that have a minimum aspect ratio (length/hydraulic radius) of 10:1, in some embodiments exceeding approximately 100:1, and in other embodiments at least about 1000:1. At the top end, the aspect ratio could be indefinitely high but generally would be less than about 1,000,000:1. The hydraulic radius of a channel is no greater than about 300 $\mu$m. In many embodiments, it can be less than 100 $\mu$m, and may be less than 10 $\mu$m. Although smaller is generally better for many applications (and the hydraulic radius could be submicron in size), the hydraulic radius typically would not be less than 1 $\mu$m for most embodiments. As more fully described below, channels defined within these parameters can provide efficient bulk fluid transport through an active fluid transport device.

The structured surface can also be provided with a very low profile. Thus, active fluid transport devices are contemplated where the structured polymeric layer has a thickness of less than 5000 micrometers, and even possibly less than 1500 micrometers. To do this, the channels may be defined by peaks that have a height of approximately 5 to 1200 micrometers and that have a peak distance of about 10 to 2000 micrometers.

Microstructured surfaces in accordance with the present invention provide flow systems in which the volume of the system is highly distributed. That is, the fluid volume that passes through such flow systems is distributed over a large area. Microstructure channel density from about 10 per lineal cm (25/in) and up to one thousand per lineal cm (2500/in) (measured across the channels) provide for high fluid transport rates. Generally, when a common manifold is employed, each individual channel has an aspect ratio that is at least 400 percent greater, and more preferably is at least 900 percent greater than a manifold that is disposed at the channel inlets and outlets. This significant increase in aspect ratio distributes the potential's effect to contribute to the noted benefits of the invention.

Distributing the volume of fluid through such a heat exchanger over a large area is particularly beneficial for many heat exchanger applications. Specifically, channels formed from microstructured surfaces provide for a large quantity of heat transfer to or from the volume of fluid passing through the device 10. This volumetric flow of fluid is maintained in a plurality of thin uniform layers through the discrete passages defined by the microchannels of the structured surface and the cover layer, which minimizes flow stagnation in the conducted flow.

Figure 4:
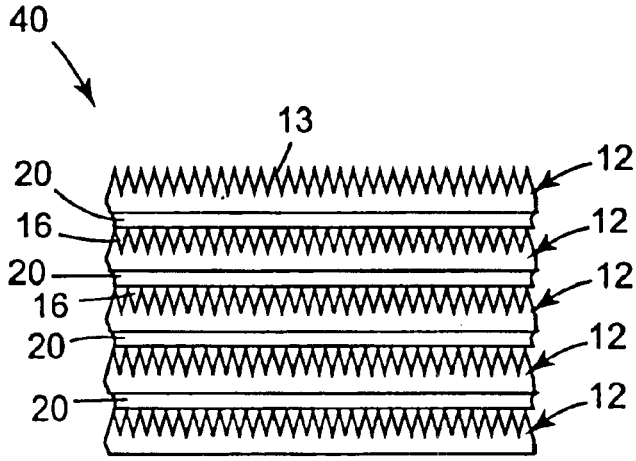
FIG. 4 is an end view of a stack of microstructured layers that are disposed upon one another with thermally conductive cover layers interleaved within the stack so that bottom major surfaces of the cover layers close off the microstructured surface of a lower layer for defining multiple discrete flow passages.

In another aspect, a plurality of layers 12, each having a microstructured surface 13, can be constructed to form a stack 40, as shown in FIG. 4. This construction clearly multiples the ability of the structure to transport fluid. That is, each layer adds a multiple of the number of channels and flow capacity. It is understood that the layers may comprise different channel configurations and/or number of channels, depending on a particular application. Furthermore, it is noted that this type of stacked construction can be particularly suitable for applications that are restricted in width and therefore require a relatively narrow fluid transport heat exchanger from which a certain heat transfer rate, and thus a certain fluid transfer capacity, is desired. Thus, a narrow device can be made having increased flow capacity for heat exchange capacity.

In the stack 40 illustrated in FIG. 4, cover layers 20 are interleaved within the stack 40 to enhance heat exchange between adjacent structures. The cover layers 20 preferably comprise material having better thermal conductivity than the layers 12 for facilitating heat exchange between fluid flowing through the structured surface of one layer 12 and an adjacent layer 12.

The stack 40 can comprise less cover layers 20 than the number of layers 12 or no cover layers 20 with a plurality of layers 12. A second major surface (that is, the oppositely facing surface than structured surface 13) of any one of or all of the layers 12 can be utilized to directly contact an adjacent structured surface so as to close off at least a plurality of the channels 16 of an adjacent layer 12 and to define the plural discrete flow passages. That is, one layer 12 can comprise the cover layer for an adjacent layer 12. Specifically, the second major surface of one layer 12 can function for closing plural channels 16 of an adjacent layer 12 in the same manner as a non-structured cover layer 20. In the case where it is desirable to facilitate heat transfer with an object external to the stack 40, intermediate non-structured cover layers 20 may not be needed although one cover layer 20 may be provided as the top surface (as viewed in FIG. 4) for thermally affecting the object by that top cover layer 20. The layers of stack 40 (plural layers 12 with or without non-structured cover layers 20) may be bonded to one another in any number of conventional ways, or they may simply be stacked upon one another whereby the structural integrity of the stack can adequately define discrete flow passages. This ability is enhanced, as above, in the case where a vacuum is to be utilized as the potential source which will tend to secure the layers of stack 40 against each other or against cover layers interposed between the individual layers. The channels 16 of any one layer 12 may be connected to a different fluid source from another or all to the same source. Thus, heat exchange can be accomplished between two or more fluids circulated within the stack 40.

Figure 6:
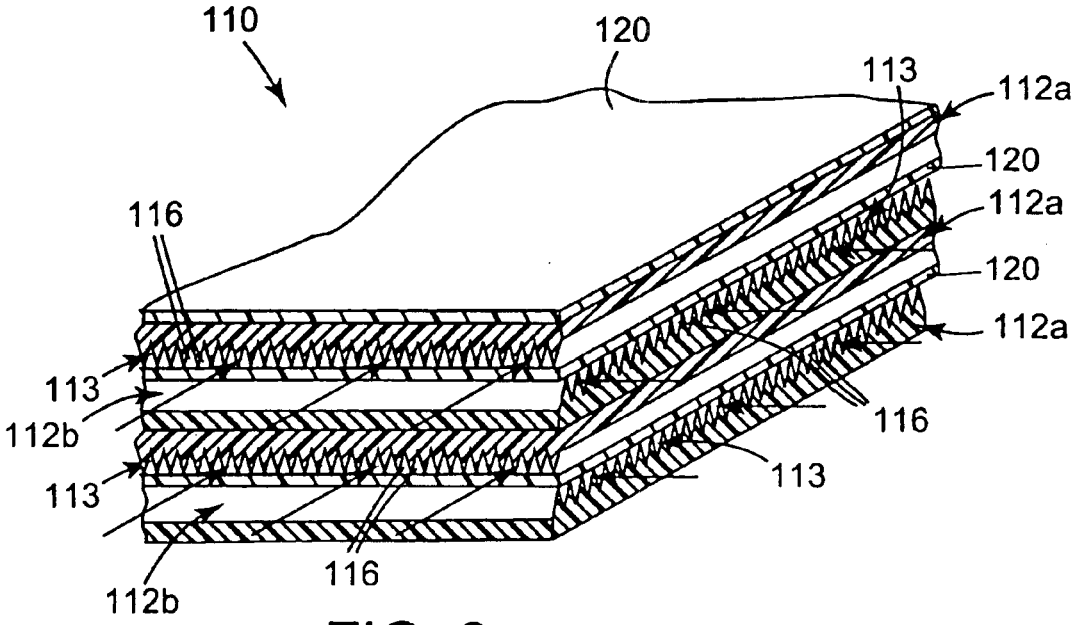
FIG. 6 is a perspective representation of a portion of an active fluid transport heat exchanger having a stack of microstructured layers disposed upon one another, with cover layers of thermally conductive material positioned between adjacent and opposing structured surfaces of the stacked layers to define discrete flow passages, the layers positioned in a manner that permits active fluid transport of two separate fluids through the flow passages to promote heat transfer from one fluid to the other fluid.

A layered construction comprising a stack of polymeric layers, each having a microstructured surface, is advantageously useable in the making of a heat exchanger 110 for rapidly cooling or heating a second fluid source, such as is represented in FIG. 6. The heat exchanger 110 of FIG. 6 employs a stack of individual polymeric layers 112 having a structured surface 113 over one major surface thereof which define flow channels 116 in layer 112. The direction of the flow channels 116 of each individual layer 112 may be different from, and, as shown can be substantially perpendicular to, the direction of the flow channels of an adjacent layer 112. In this manner, channels 116 of layer 112*a* of heat exchanger 110 can promote fluid flow in a longitudinal direction, while channels 116 of layer 112*b* promote fluid flow in a transverse direction through heat exchanger 110.

As above, the second major surface of layers 112 can act as a cover layer closing the channels 116 defined by the microstructured surface 113 of an adjacent layer 112. Alternatively, as shown in FIG. 6, cover layers 120 can be interposed between the opposing first major surfaces in which structured surfaces 113 are formed of adjacent layers 112*a* and 112*b*. That is, the layers 112*a* having channels 116 aligned in a longitudinal direction are inverted from the configuration associated with stack 40 of FIG. 4 so that structured surface 113 of these longitudinal layers 112*a* face the structured surface 113 of the transverse layer 112*b* immediately beneath layer 112*a*. In this manner, cover layer 120 is directly interposed between flow channels 116 of opposing layers 112 to close off channels 116 of each adjacent layer 112, and thus define longitudinal and transverse discrete flow passages.

A first potential can be applied across the longitudinal layers 112*a* to promote fluid flow from a first fluid source through the flow passages of longitudinal layers 112*a*. A second potential can be applied across the transverse layers 112*b* to promote flow fluid from a second fluid source. In this manner, cover layer 120 is interposed between a pair of opposing fluid flows. Heat transfer from the first fluid flow can thereby be effected across cover layer 120 to rapidly heat or chill the second fluid source. As above, microstructured surfaces 113 of layers 112 promote a plurality of uniform thin fluid flows through the flow passages of heat exchanger 110, thus aiding in the rapid heat transfer between the opposing flows. Any number of sources can be used for selectively generating fluid flow within any number of the channels within a layer or between any of the layers.

FIG. 6 further illustrates a cover layer 120 attached to the second major surface of the top layer 112*a* of heat exchanger 110. This top cover layer 120 can be beneficially used to thermally affect a desired media or other fluid by receiving heat transfer from the first fluid in flow channels 116 through the second major surface of the layer 112*a*. Depending on the material chosen for layer 112*a*, the top cover layer 120 can provide less heat transfer than the cover layers 120 that are interposed directly between the opposing fluid flows of heat exchanger 110 for beneficially providing a lower rate of heat transfer to sensitive media to be thermally affected, such as for example, living tissue, while still permitting heat exchanger 110 to act as a rapid fluid-to-fluid heat transfer device.

Figure 7A:
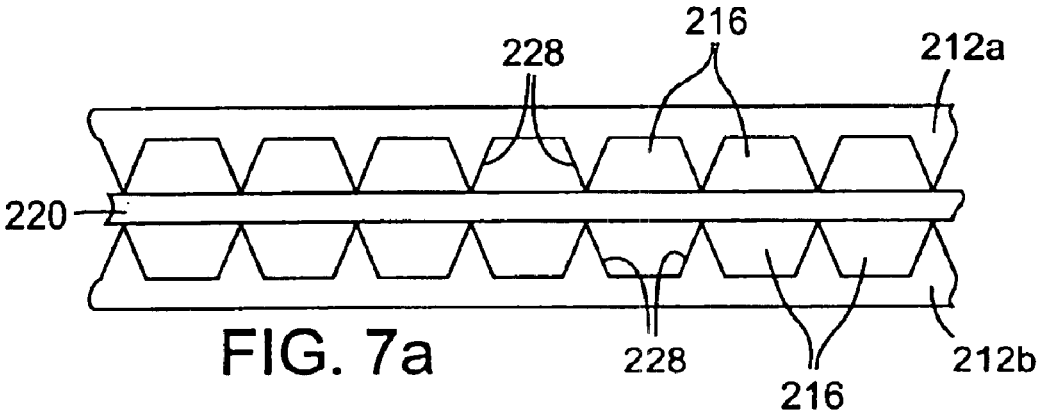
FIGS. 7*a* and 7*b* are partial end views of a pair of microstructured layers showing possible channel configurations with a layer of thermally conductive material disposed between the structured surfaces of the layers for permitting heat transfer between two fluids.
Figure 7B:
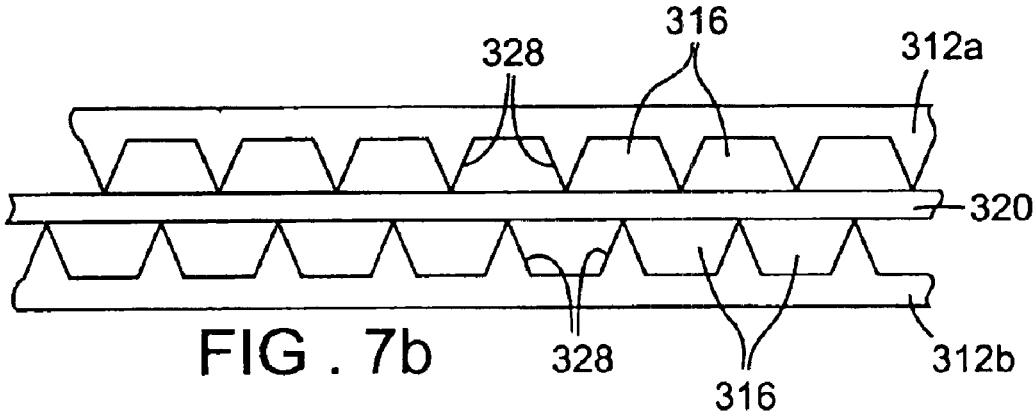

While heat exchanger 110 of FIG. 6 shows the flow channels 116 of alternating layers 112 aligned substantially perpendicular to each other, the microstructure channels of the alternating layers associated with the separate fluid flows can be arranged in any number of manners as required by a specific application. For example, FIG. 7*a* illustrates a layer 212*a* that can receive fluid from a first source and a second layer 212*b* that can receive fluid from a second source that is distinct from the first source. Each of the layers 212*a* and 212*b* have channels 216 formed on a first major surface of the respective layers. Cover layer 220 of thermally conductive material is interposed between the channels 216 of layers 212*a* and 212*b* to define discrete flow passages and to promote heat transfer between a first fluid flow across layer 212*a* and a second fluid flow across layer 212*b*. Channels 216 of layers 212*a* and 212*b* are aligned substantially parallel with respect to each other. In the embodiment of FIG. 7*a*, peaks 228 of the channels 216 of layers 212*a* and 212*b* are aligned opposite each other. FIG. 7*b* shows layers 212*a* and 212*b* having peaks 228 of layers 212*a* that are aligned between peaks 228 of opposing layer 212*b*.

Many other configurations of a stack of layers having a microstructured surface are also contemplated. For example, the channels may be aligned parallel to each other as in FIGS. 7*a* and 7*b*, or perpendicular as in FIG. 6, or arranged in any other angular relation to each other as required by a specific application. Individual layers of a heat exchanger having a plurality of stacked layers can contain more or less microstructured channels as compared to other layers in the stack, and the flow channels may be linear or non-linear in one or more layers of a stacked structure.

It is further contemplated that a stacked construction of layers in accordance with those described herein may include plural stacks arranged next to one another. That is, a stack such as shown in FIG. 4 or FIG. 6 may be arranged adjacent to a similar or different stack. Then, they can be collected together by an adapter, or may be individually attached to fluid transfer tubing, or the like to provide heat transfer in a desired manner.

Figure 8:
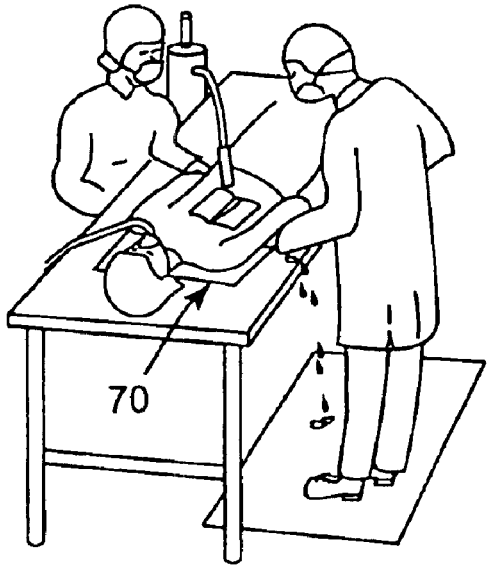
FIG. 8 shows multiple uses of active fluid transfer devices, including the use of a flexible active fluid transfer heat exchanger positioned beneath a patient during a medical procedure to thermally affect the patient.

An example of an active fluid transfer heat exchanger in accordance with the present invention is illustrated in FIG. 8. In the medical field of usage, a patient is shown positioned on an active fluid transport heat exchanger 70 (that may be in the form of a flexible blanket) such as is described above for thermally affecting the patient (e.g. with heating or cooling).

Heat transfer devices of these constructions possess some benefits. Because the heat transfer fluid can be maintained in very small channels, there would be minimal fluid stagnation in the channels. Fluids in laminar flow in channels exhibit a velocity flow profile where the fluid at the channel's center has the greatest velocity. Fluid at the channel boundary in such flow regimes is essentially stagnate. Depending on the size of a channel, the thermal conductivity of the fluid, and the amount of time a fluid spends moving down the channel, this flow profile can create a significant temperature gradient across the channel. In contrast, channels that have a minimum aspect ratio and a hydraulic radius in accordance with the invention will display a smaller temperature gradient across the channel because of the small heat transfer distance. A smaller temperature gradient is advantageous as the fluid will experience a uniform heat load as it passes through the channel.

Residence time of the heat transfer fluid throughout the system of small channels also can be essentially uniform from an inlet manifold to an outlet manifold. A uniform residence time is beneficial because it minimizes non-uniformity in the heat load a fluid experiences.

The reduction in temperature gradient and the expression of a uniform residence time also contribute to overall efficiency and, for a given rate of heat transfer, allow for smaller temperature differentials between the heat transfer fluid and the element to be heated or cooled. The smaller temperature differentials reduce the chance for local hot or cold zones that would be undesirable when the heat exchanger is used in thermally sensitive applications such as skin or tissue contact. The high contact surface area, per unit volume of heat transfer fluid, within the heat transfer module increases the system's volumetric efficiency.

The heat transfer device may also be particularly useful in confined areas. For example, a heat exchanger in accordance with the present invention can be used to provide cooling to a computer microchip within the small spaces of a data storage or processing unit. The material economics of a microstructure-bearing film based unit would make them appropriate for limited or single use applications, such as in medical devices, where disposal is required to address contamination concerns.

A heat transfer device of the invention is beneficial in that it can be flexible, allowing its use in various applications. The device can be contoured around tight bends or curves. The flexibility allows the devices to be used in situations that require intimate contact to irregular surfaces. The inventive fluid transport heat exchanger, may be fashioned to be so flexible that the devices can be conformed about a mandrel that has a diameter of approximately one inch (2.54 cm) or greater without significantly constricting the flow channels or the structured polymeric layer. The inventive devices also could be fashioned from polymeric materials that allow the heat exchanger to be non-detrimentally conformed about a mandrel that is approximately 1 cm in diameter.

The making of structured surfaces, and in particular microstructured surfaces, on a polymeric layer such as a polymeric film are disclosed in U.S. Pat. Nos. 5,069,403 and 5,133,516, both to Marentic et al. Structured layers may also be continuously microreplicated using the principles or steps described in U.S. Pat. No. 5,691,846 to Benson, Jr. et al. Other patents that describe microstructured surfaces include U.S. Pat. No. 5,514,120 to Johnston et al., U.S. Pat. No. 5,158,557 to Noreen et al., U.S. Pat. No. 5,175,030 to Lu et al., and U.S. Pat. No. 4,668,558 to Barber.

Structured polymeric layers produced in accordance with such techniques can be microreplicated. The provision of microreplicated structured layers is beneficial because the surfaces can be mass produced without substantial variation from product-to-product and without using relatively complicated processing techniques. "Microreplication" or "microreplicated" means the production of a microstructured surface through a process where the structured surface features retain an individual feature fidelity during manufacture, from product-to-product, that varies no more than about 50 $\mu$m. The microreplicated surfaces preferably are produced such that the structured surface features retain an individual feature fidelity during manufacture, from product-to-product, which varies no more than 25 $\mu$m.

Fluid transport layers for any of the embodiments in accordance with the present invention can be formed from a variety of polymers or copolymers including thermoplastic, thermoset, and curable polymers. As used here, thermoplastic, as differentiated from thermoset, refers to a polymer which softens and melts when exposed to heat and re-solidifies when cooled and can be melted and solidified through many cycles. A thermoset polymer, on the other hand, irreversibly solidifies when heated and cooled. A cured polymer system, in which polymer chains are interconnected or crosslinked, can be formed at room temperature through use of chemical agents or ionizing irradiation.

Polymers useful in forming a structured layer in articles of the invention include but are not limited to polyolefins such as polyethylene and polyethylene copolymers, polyvinylidene diflouride (PVDF), and polytetrafluoroethylene (PTFE). Other polymeric materials include acetates, cellulose ethers, polyvinyl alcohols, polysaccharides, polyolefins, polyesters, polyamids, poly(vinyl chloride), polyurethanes, polyureas, polycarbonates, and polystyrene. Structured layers can be cast from curable resin materials such as acrylates or epoxies and cured through free radical pathways promoted chemically, by exposure to heat, UV, or electron beam radiation.

As indicated above, there are applications where flexible active fluid transport heat exchangers are desired. Flexibility may be imparted to a structured polymeric layer using polymers described in U.S. Pat. No. 5,450,235 to Smith et al. and U.S. Pat. No. 5,691,846 to Benson, Jr. et al. The whole polymeric layer need not be made from a flexible polymeric material. A main portion of the layer, for example, could comprise a flexible polymer, whereas the structured portion or portion thereof could comprise a more rigid polymer. The patents cited in this paragraph describe use of polymers in this fashion to produce flexible products that have microstructured surfaces.

Polymeric materials including polymer blends can be modified through melt blending of plasticizing active agents such as surfactants or antimicrobial agents. Surface modification of the structured surfaces can be accomplished through vapor deposition or covalent grafting of functional moieties using ionizing radiation. Methods and techniques for graft-polymerization of monomers onto polypropylene, for example, by ionizing radiation are disclosed in U.S. Pat. Nos. 4,950,549 and 5,078,925. The polymers may also contain additives that impart various properties into the polymeric structured layer. For example, plasticisers can be added to decrease elastic modulus to improve flexibility.

Preferred embodiments of the invention may use thin flexible polymer films that have parallel linear topographies as the microstructure-bearing element. For purposes of this invention, a "film" is considered to be a thin (less than 5 mm thick) generally flexible sheet of polymeric material. The economic value in using inexpensive films with highly defined microstructure-bearing film surfaces is great. Flexible films can be used in combination with a wide range of cover layer materials and can be used unsupported or in conjunction with a supporting body where desired. The heat exchanger devices formed from such microstructured surfaces and cover layers may be flexible for many applications but also may be associated with a rigid structural body where applications warrant.

Because the active fluid transport heat exchangers of the invention preferably include microstructured channels, the devices commonly employ a multitude of channels per device. As shown in some of the embodiments illustrated above, inventive active fluid transport heat exchangers can easily possess more than 10 or 100 channels per device. Some applications, the active fluid transport heat exchanger may have more than 1,000 or 10,000 channels per device. The more channels that are connected to an individual potential source allow the potential's effect to be more highly distributed.

The inventive active fluid transport heat exchangers of the invention may have as many as 10,000 channel inlets per square centimeter cross section area. Active fluid transport heat exchangers of the invention may have at least 50 channel inlets per square centimenter. Typical devices can have about 1,000 channel inlets per square centimeter.

As noted above in the Background section, examples of heat exchangers having microscale flow pathways are known in the art. Sacrificial cores or fibers are removed from a body of deposited material to form the microscale pathways. The application range of such devices formed from these fibers are limited, however. Fiber fragility and the general difficulty of handling bundles of small individual elements hampers their use. High unit cost, fowling, and lack of geometric (profile) flexibility further limits application of these fibers as fluid transport means. The inability to practically order long lengths and large numbers of hollow fibers into useful transport arrays make their use inappropriate for all but a limited range of active fluid transport heat exchange applications.

The cover layer material, described above with respect to the illustrated embodiments, or the surface of an object to be thermally affected provide the closing surface that encloses at least a portion of at least one microstructured surface so as to create plural discrete flow passages through which fluid may move. A cover layer provides a thermally conductive material for promoting heat transfer to a desired object or media. The interior surface of the cover layer material is defined as the closing surface facing and in at least partial contact with the microstructured polymeric surface. The cover layer material is preferably selected for the particular heat exchange application, and may be of similar or dissimilar composition to the microstructure-bearing surface. Materials useful as the cover layer include but are not limited to copper and aluminum foils, a metalisized coated polymer, a metal doped polymer, or any other material that enhances heat transfer in the sense that the material is a good conductor of heat as required for a desired application. In particular, a material that has improved thermal conductivity properties as compared to the polymer of the layer containing the microstructure surface and that can be made on a film or a foil is desirable.

EXAMPLE

To determine the efficacy of an active fluid transport heat exchanger having a plurality of discrete flow passages defined by a layer having microchannels in a microstructured surface and a cover layer, a heating and cooling device was constructed using a capillary module formed from a microstructure-bearing film element, capped with a layer of metal foil. The microstructure-bearing film was formed by casting a molten polymer onto a microstructured nickel tool to form a continuous film with channels on one surface. The channels were formed in the continuous length of the cast film. The nickel casting tool was produced by shaping a smooth copper surface with diamond scoring tools to produce the desired structure followed by an electroless nickel plating step to form a nickel tool. The tool used to form the film produced a microstructured surface with abutted 'V' channels with a nominal depth of 459 $\mu$m and an opening width of 420 $\mu$m. This resulted in a channel, when closed with a cover layer, with a mean hydraulic radius of 62.5 $\mu$m. The polymer used to form the film was low density polyethylene, Tenite™ 1550P from Eastman Chemical Company. A nonionic surfactant, Triton X-102 from Rohm & Haas Company, was melt blended into the base polymer to increase the surface energy of the film.

The surface dimension of the laminate was 80 mm×60 mm. The metal foil used was a sheet of aluminum with a thickness of 0.016 mm, from Reynolds Co. The foil and film were heat welded along the two sides parallel to the linear microstructure of the film. In this manner, substantially discrete flow passages were formed.

A pair of manifolds were then fitted over the ends of the capillary module. The manifolds were formed by placing a cut in the side wall of a section of tubing, VI grade 3.18 mm inner diameter, 1.6 mm wall thickness tubing from Nalge Co. of Rochester, N.Y. The slit was cut with a razor in a straight line along the axis of each tube. The length of the slit was approximately the width of the capillary module. Each tube was then fitted over an end of the capillary module and hot melt glued in place. One open end of the tubes, at the capillary module, was sealed closed with hot melt adhesive.

To evaluate the heat transfer capacity of the test module, water was drawn through the module and cooled by an ice bath placed in direct contact with the foil surface. The temperature of the inlet water to the heat exchange module was 34° C. with the corresponding bath temperature at 0° C. Water was drawn through the unit at the rate of 150 ml/min while a slight agitation of the ice bath was maintained. The volume of water drawn through the test module was 500 ml. Temperature of the conditioned water was 20° C. The drop in temperature of the transported fluid demonstrates the effectiveness of the test module to transfer and remove heat.

All of the patents and patent applications cited above are wholly incorporated by reference into this document. Also, this application also wholly incorporates by reference the following patent applications that are commonly owned by the assignee of the subject application and filed on even date herewith: U.S. patent application Ser. No. 09/099,269 to Insley et al. and entitled "Microchanneled Active Fluid Transport Devices"; U.S. patent application Ser. No. 09/106,506 to Insley et al. and entitled "Structured Surface Filtration Media"; U.S. patent application Ser. No. 09/100,163 to Insley et al. and entitled "Microstructured Separation Device"; and U.S. patent application Ser. No. 09,099,565 to Insley et al. and entitled "Fluid Guide Device Having an Open Microstructured Surface for Attachment to a Fluid Transport Device."

Although the present invention has been described with reference to preferred embodiments, workers skilled in the art will recognize that changes may be made in form and detail without departing from the spirit and scope of the invention.

What is claimed is:

1. A heat exchanger for use with active fluid transport, comprising:

(a) a first layer of polymeric film material having first and second major surfaces, wherein the first major surface includes a structured surface having a plurality of flow channels that extend from a first point to a second point along the surface of the first layer and that have a minimum aspect ratio of the channel's length to its hydraulic radius of about 10:1 and a hydraulic radius of no greater than about 300 micrometers;

(b) a first cover layer that overlies at least a portion of the structured polymeric surface and includes a closing surface to cover at least a portion of the plurality of flow channels to make plural substantially discrete flow passages; and (c) a manifold in fluid communication with the substantially discrete flow passages to allow a potential from a potential source to promote fluid movement through the passages from a first potential to a second potential, such fluid movement for thermally affecting the first cover layer of material for promoting heat transfer between the moving fluid and the first cover layer.

2. The heat exchanger of claim 1, wherein said first cover layer comprises a second layer of polymeric film material having first and second major surfaces, the first major surface of the second layer including a structured surface having a plurality of flow channels, and the second major surface of the second layer providing the closing surface making the plural substantially discrete flow passages of the first layer.

3. The heat exchanger of claim 2, further comprising at least one additional layer of polymeric film material having first and second major surfaces, the first major surface of each additional layer including a structured surface having a plurality of flow channels, the first, second and additional layers of polymeric film material being stacked on top of one another to form a stacked array having a plural ordered rows of substantially discrete flow passages.

4. The heat exchanger of claim 1, further comprising a second layer of polymeric film material having first and second major surfaces, the first major surface of the second layer including a structured surface having a plurality of flow channels, the second layer being stacked on top of the first cover layer that overlies the first layer to form a stacked array.

5. The heat exchanger of claim 4, further comprising a second cover layer of material, wherein at least a portion of the second major surface of the second layer of polymeric film material is secured to the first cover layer, and the second cover layer is secured to at least a portion of the structured surface of the second layer of polymeric film material to make substantially discrete flow passages.

6. The heat exchanger of claim 4, wherein at least a portion of the structured surface of the first major surface of the second layer of polymeric material is secured to the first cover layer to cover the flow channels of the second layer of polymeric material to make substantially discrete flow passages.

7. The heat exchanger of claim 6, wherein the flow channels of the first layer of polymeric material and the flow channels of the second layer of polymeric material are substantially linear and are arranged in an angular relationship with respect to one another.

8. The heat exchanger of claim 7, wherein the flow channels of the first and second layers of polymeric material are aligned substantially parallel to each other.

9. The heat exchanger of claim 1, further comprising a plurality of layers of polymeric film material, each of the plurality of layers of polymeric film material having a first major surface defined by a structured surface formed within the layer, the structured surface having a plurality of flow channels that extend from a first point to a second point along the surface of the layer, the plurality of flow channels having a minimum aspect ratio of the channel's length to its hydraulic radius of about 10:1 and a hydraulic radius of no greater than about 300 micrometers, and wherein the plurality of layers of polymeric film material and the first cover layer are arranged in a stacked array, with the first cover layer interposed between an adjacent pair of layers of polymeric film material so that the first cover layer covers at least a portion of the structured surface of one of the adjacent pair of layers of polymeric film material to make substantially discrete flow passages.

10. The heat exchanger of claim 9, further comprising a plurality of cover layers interposed between the layers of polymeric film material and covering at least portions of the structured surfaces of such layers of polymeric film material and to make plural ordered rows of substantially discrete flow passages.

11. The heat exchanger of claim 10, wherein each of the plurality of cover layers is interposed between a different pair of adjacent layers of polymeric material so that each cover layer closes the flow channels of the structured surface of one of an adjacent pair of layers of polymeric material to make substantially discrete flow passages.

12. The heat exchanger of claim 9, wherein the flow channels of adjacent layers of polymeric film material are substantially linear and are aligned in an angular relationship to each other.

13. The heat exchanger of claim 12, wherein the flow channels of the adjacent layers are aligned substantially parallel to each other.

14. The heat exchanger of claim 12, wherein the flow channels of the adjacent layers are aligned substantially perpendicular to each other.

15. The heat exchanger of claim 1, wherein the first cover layer is more thermally conductive than the first layer of polymeric film material.

16. The heat exchanger of claim 15, wherein the first cover layer includes metal within its composition.

17. The heat exchanger of claim 16, wherein the first cover layer comprises a metal foil.

18. The heat exchanger of claim 10, wherein the plurality of cover layers are more thermally conductive than the layers of polymeric film material.

19. The heat exchanger of claim 18, wherein the cover layers include metal within their composition.

20. The heat exchanger of claim 19, wherein the cover layers comprise metal foil.

21. The heat exchanger of claim 1, wherein the first layer comprises a microreplicated layer.

22. The heat exchanger of claim 1, wherein the first cover layer has greater thermal conductivity than the polymeric film material of the first layer.

23. The heat exchanger of claim 1, wherein the heat exchanger can conform about a mandrel that has a diameter of at least about one centimeter (about 0.39 inches) without significantly constricting flow through the plurality of flow passages.

24. A method of transferring heat between a heat transfer fluid and another media that is to be thermally effected in proximity to a heat exchanger, comprising the steps of:

(a) providing a heat exchanger comprising a layer of polymeric film material having first and second major surfaces, wherein the first major surface includes a structured surface having a plurality of flow channels that extend from a first point to a second point along the surface of the layer, and that have a minimum aspect ratio of the channel's length to its hydraulic radius of about 10:1 and a hydraulic radius of no greater than about 300 micrometers;

(b) connecting a source of heat exchange fluid having a predetermined initial temperature to flow passages comprised of the flow channels;

(c) placing the heat exchanger in a position to conduct heat between the other media and the fluid within the heat exchanger; and (d) providing a source of potential over the flow passages of the heat exchanger, and thereby moving the fluid through the flow passages from a first potential to a second potential, the movement of the fluid causing heat transfer between the moving fluid and the other media so as to thermally affect the media in proximity to the heat exchanger.

25. The method of transferring heat of claim 24, further including a step of providing a cover layer to a portion of the structured surface of the layer of polymeric film material having a closing surface to cover at least a portion of the flow channels to make plural substantially discrete flow passages, and wherein the cover layer is placed in a position to conduct heat between the other media and the fluid within the heat exchanger.

26. The method of transferring heat of claim 25, wherein the step of placing the heat exchanger with its cover layer in a position to conduct heat between the other media and the fluid within the heat exchanger includes placing the cover layer of the heat exchanger in direct contact with the other media to conduct heat through conduction between the other media and the fluid within the heat exchanger.

27. The method of transferring heat of claim 25, wherein the step of placing the heat exchanger with its cover layer in a position to conduct heat between the other media and the fluid within the heat exchanger includes spacing the cover layer of the heat exchanger apart from the other media to conduct heat through convection between the other media and the fluid within the heat exchanger.

28. The method of transferring heat of claim 25, wherein:

the step of providing a heat exchanger includes providing a heat exchanger having a second layer of polymeric material stacked on top of the cover layer, the second layer of material having a first major surface that includes a structured surface formed within the layer, the structured surface having a plurality of flow channels that extend from a first point to a second point along the surface of the second layer of polymeric material, at least a portion of the flow channels of the second layer being covered by the cover layer to make plural substantially discrete flow passages; and the step of placing the heat exchanger with its cover layer in a position to conduct heat includes fluidically connecting the flow passages made by the channels of the second layer of polymeric material to a second source of fluid to conduct heat between the second source of fluid and the fluid having a predetermined initial temperature.

* * * * *